US006500103B2

(12) United States Patent
Porter

(10) Patent No.: US 6,500,103 B2
(45) Date of Patent: Dec. 31, 2002

(54) ABDOMINAL EXERCISE APPARATUS

(76) Inventor: Edward L. Porter, P.O. Box 1061, Belleville, MI (US) 48112

( * ) Notice: Subject to any disclaimer, the term of this patent is extended or adjusted under 35 U.S.C. 154(b) by 0 days.

(21) Appl. No.: 09/416,520

(22) Filed: Oct. 9, 1999

(65) Prior Publication Data

US 2002/0107119 A1 Aug. 8, 2002

(51) Int. Cl.[7] ..... A63B 21/02

(52) U.S. Cl. ..... 482/121; 482/122; 297/468; 297/471

(58) Field of Search ..... 482/91, 92, 121, 482/122, 123, 127, 128, 129, 130, 134, 135, 139, 908; 297/486, 468, 470, 471, 485

(56) References Cited

U.S. PATENT DOCUMENTS

| | | | | |
|---|---|---|---|---|
| 894,052 A | | 7/1908 | Radtke | |
| 2,443,191 A | | 6/1948 | Miller | 244/122 |
| 2,871,927 A | | 2/1959 | Materi | 155/189 |
| 3,744,814 A | | 7/1973 | Sturman | 280/150 SB |
| 3,807,798 A | | 4/1974 | Mattson | 297/386 |
| 5,141,482 A | * | 8/1992 | Hern | 482/130 |
| 5,205,803 A | * | 4/1993 | Zemitis | 482/121 |
| 5,333,935 A | | 8/1994 | DiPaola | 297/471 |
| 5,704,880 A | * | 1/1998 | Amatulle | 482/54 |
| 6,013,014 A | * | 1/2000 | Hern | 482/121 |
| 6,183,403 B1 | * | 2/2001 | Dunn | 482/121 |

* cited by examiner

*Primary Examiner*—Jerome W. Donnelly
*Assistant Examiner*—Tam Nguyen
(74) *Attorney, Agent, or Firm*—Gifford, Krass, Groh, Sprinkle, Anderson & Citkowski, P.C.

(57) ABSTRACT

An exercise belt for use while seated in a normal position in a motor vehicle and preferably while using the installed safety harness in which the exercise belt incorporates a resilient resistance member extending diagonally across the chest of the user and held in position by oppositely extending tie straps tied to brackets secured to the vehicle. The tie straps are adjustable in length to adjust the position of the resistance member and one of the tie straps is provided with a quick release buckle to facilitate removal of the exercise belt when not is use.

18 Claims, 2 Drawing Sheets

ABDOMINAL EXERCISE APPARATUS

FIELD OF THE INVENTION

The present invention relates to exercise equipment and more particularly to exercise equipment which can be used in a motor vehicle by both drivers and passengers.

BACKGROUND OF THE INVENTION

A large number of people spend a great deal of time seated in motor vehicles in pursuit of their employment. For example, truck drivers spend all of their work day seated in a tractor of a tractor-trailer combination. Also, most people commute to their place of employment by using passenger automobiles.

In view of the large amount of time that people spend operating and traveling in vehicles it would be useful to provide equipment that would allow such travelers the ability to exercise during the time that the vehicle is being operated. It also would be useful for that exercise equipment to allow the vehicle operator to control the vehicle in an otherwise normal manner while still providing a reasonable level of beneficial exercise.

Almost all present day vehicles are equipped with safety belts to restrain movement of operators and passengers in the event of an impact such as that experienced in collisions and accidents. Such belts are usually in the form of lap belts which restrain movement and shoulder belts which permit limited movement until there is rapid deceleration of the vehicle upon impact in a collision.

Although operators and passengers of vehicles are restricted in their movement, it is highly desirable to afford some form of physical exercise without impairing the operation of the safety equipment such as the safety belts and harness.

SUMMARY OF THE INVENTION

The present invention is an exercise device that provides resistance to the operator's normal physical motions without impairing operating safety and thus allows the operator to receive physical exercise while operating the vehicle.

It is an object of the invention to provide exercise equipment for use by a person seated in a motor vehicle using the safety belt or harness equipment with which the vehicle is typically equipped without impairing the operation and effectiveness of such safety equipment.

Another object of the invention is to provide exercise equipment which can be used in conjunction with the use of the safety belt and safety harness equipment in a motor vehicle which offer's resilient resistance to the limited movement that the safety belt equipment affords without impairing the use of the safety equipment.

Another object of the invention is to provide exercise equipment in the form of a belt assembly which can be used simultaneously with the wearing of safety harness and seat belts in motor vehicles.

These and other objects of the invention are attained by exercise equipment to be used by persons seated in the motor vehicle equipped with a safety belt harness in which the exercise equipment incorporates an elongated resistance member which resiliently resists elongation. The opposite ends of the resistance member is provided with support or link elements which are connected to opposite ends of the resistance member and also to a pair of tie straps or belts.

The pair of tie straps are adjustable in length and have their opposite ends connected to the link elements on the resistance member and to the anchor points which secure the safety belt or harness to the vehicle. The pair of tie straps act to support the resistance member in a diagonal position across the chest of the driver or passenger so that a person seated in a vehicle and wearing safety harness can move against the resistance of the resistance member. The resistance to the operator's normal physical movement, thus allows the operator and passengers of vehicles to achieve physical exercise without impairing the person's normal range of movement.

DETAILED DESCRIPTION OF THE PREFERRED EMBODIMENT

Figure 1:
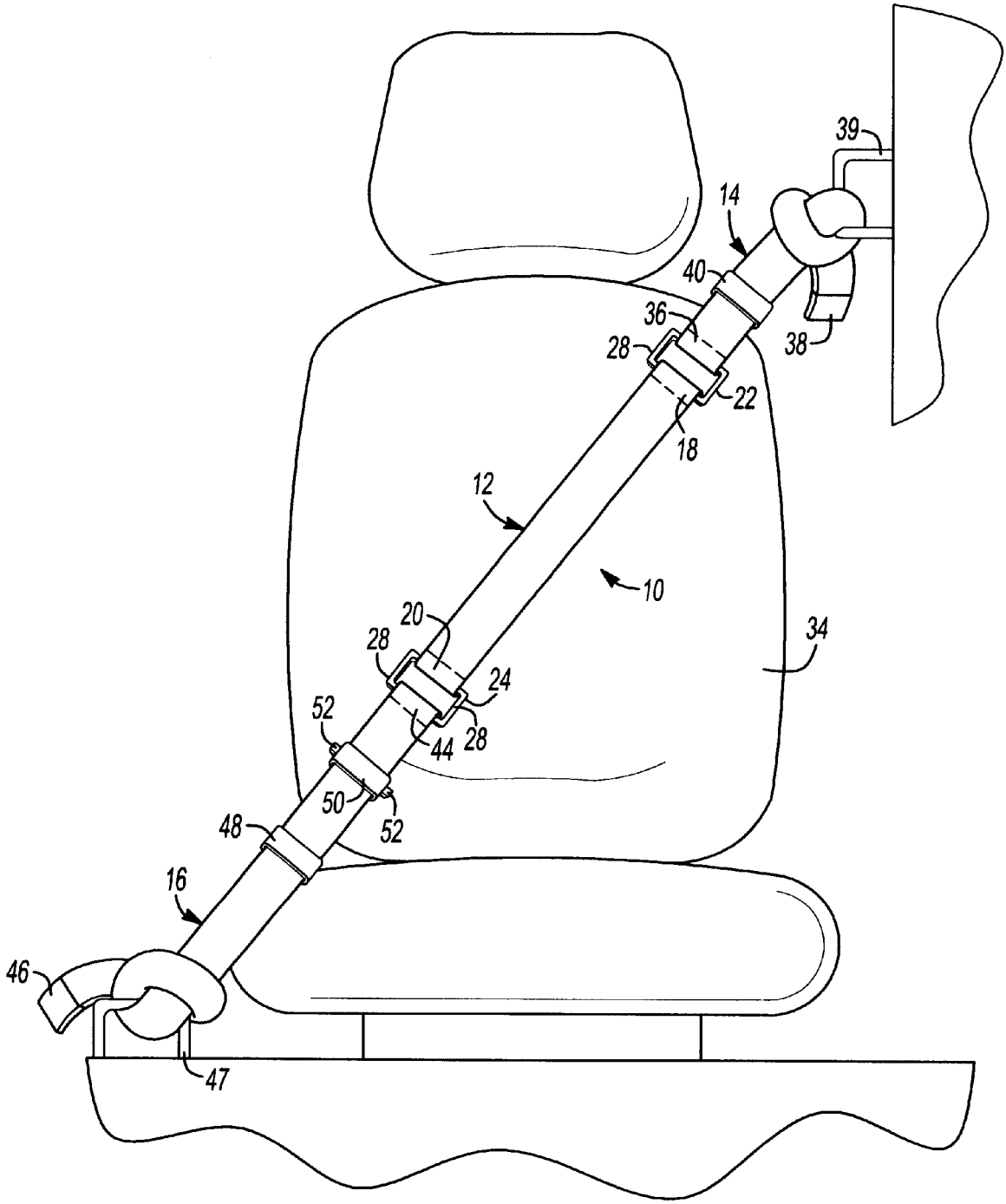
FIG. 1 is a view of the exercise equipment embodying the invention in relation to a seat in a motor vehicle.

Referring to the drawings, the exercise equipment embodying the invention is designated generally at 10 and is in the form of a belt assembly incorporating a resistance or an elastic belt member 12 joined together to an upper belt or tie strap portion 14 and a lower belt or tie strap portion 16.

The resistance belt member 12 has opposite ends 18 and 20 in the form of loops which are attached to rectangular shaped links or rings 22 and 24 respectively. Each of the links 22, 24 has opposed pairs of generally parallel edge portions 26 and 28. One of the edge portions 26 of each of the links 22, 24 fits through the loops 18 and 20 of the resistance member 12.

Figure 4:
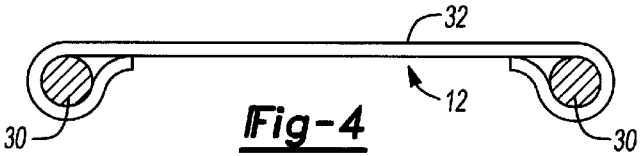
FIG. 4 is a cross-sectional view at an enlarged scale taken on line 4—4 in FIG. 2.
Figure 3:
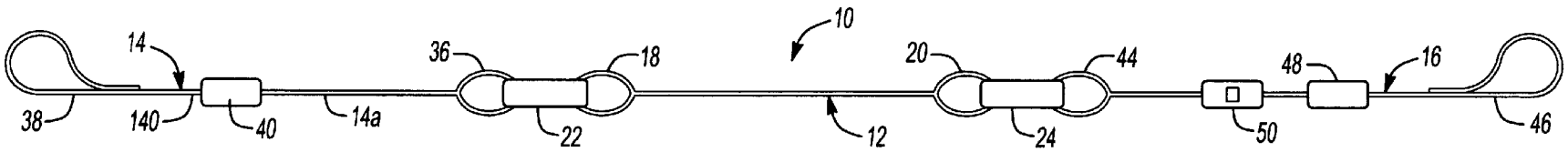
FIG. 3 is an edge view of the exercise equipment seen in FIG. 2.

In a preferred embodiment of the invention resistance belt member 12 is made up of a pair of bungee cords 30 shown in cross-section in FIG. 4. The bungee cords 30 form the opposite edges of the resistance belt member 12 and are joined together by a fabric member 32. Alternatively, the resistance belt member 12 can be made of an elastic fabric material formed with loops at its opposite ends 18 and 20 to receive rings 22 and 24.

In use, the exercise belt assembly 10 extends generally diagonally across the upper body of a person seated in a motor vehicle. As seen in FIG. 1, the exercise belt 10 is shown extending from and upper level diagonally relative to a drivers seat 34. In the case of a driver, the belt assembly 10 extends from the upper left-hand shoulder of the driver downwardly toward the lower right side. In the case of a passenger seated next to the driver, the exercise belt assembly 10 extends from the passenger's upper right to the lower left. The usual seat belt and shoulder harness is not shown in FIG. 1 but the exercise belt assembly 10 is disposed generally parallel to the shoulder harness.

In its position of use, the upper end 18 of the resistant belt 12 is attached to the upper tie strap assembly 14 which has loops 36 and 38 at its opposite end. Loop 36 receives a long edge 26 (FIG. 2) of the ring 22. The opposite loop 38 forms a finished end to the tie strap assembly 14 which is adapted to be tied to a bracket 39 secured to the vehicle. The bracket 39 is by way of example and may be any fixed bracket including the anchors for safety harness. An intermediate portion of the tie strap 14 is provided with an adjustment buckle 40 between strap portions 14*a* and 14*b* by which the tie strap assembly 14 can be elongated or shortened. Such buckles are conventional, are of a cam lock type attached to one end of strap portion 14*a* and slidably receiving a strap portion 14*b* and clamping it in a selected position relative to the buckle 40. Such buckles can be obtained from sources such as ITW Nexus in Des Plaines, Ill.

Figure 2:
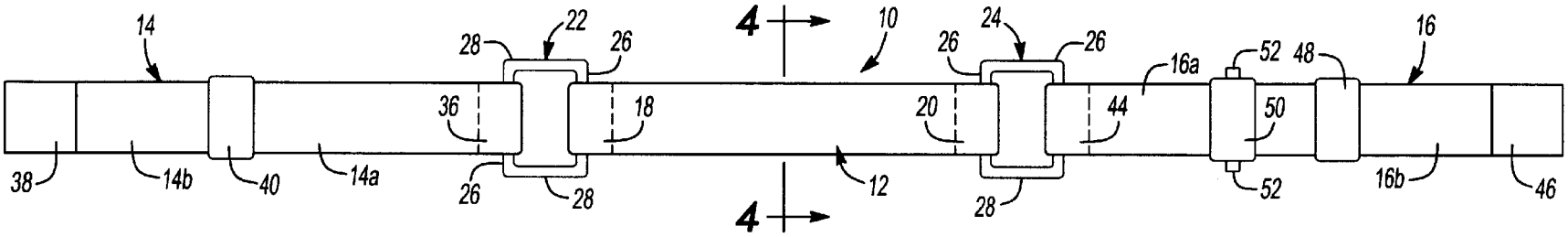
FIG. 2 is a plan view of the exercise equipment embodying the invention in the form of a belt assembly.

In a similar manner, the resistance member 12 is attached to the lower tie strap assembly 16. The tie strap assembly 16 has loops 44 and 46 formed at its opposite ends. The loop 44 is attached to the ring 24 at the lower end of the resistance belt 12 and the loop 46 finishes the end of the tie strap assembly which is adapted to be tied to a bracket 47 secured to or near the floor of the vehicle.. An intermediate portion of the lower tie strap 16 is provided with an adjustment buckle 48 identical to the buckle 40 which separates tie strap 16 into strap portions 16*a* and 16*b* (FIG. 2). The buckle 48 permits the lower tie strap assembly 16 to be elongated or shortened by clamping portions 16*a* and 16*b* relative to each other.

An intermediate portion of the tie strap portion 16*a* adjacent to the buckle 48 is provided with a quick release fitting 50. Such fittings also can be obtained from sources such as ITW Nexus as mentioned above. Pressure on opposed latch buttons 52 permits separation of the tie strap 16 and releases the wearer from the confines of the exercise belt 10.

To use the exercise equipment 10, the entire belt assembly is installed in a vehicle. The upper portion of the upper belt assembly 14 is tied to the bracket 39 or other anchor attached to the vehicle. Similarly the lower end of the lower belt or tie strap 16 is tied to vehicle seat belt anchor bracket 47 near the floor board of the vehicle to position the entire exercise belt assembly 10 diagonally across the upper body portion of a user with resistance member 12 extending diagonally across the chest of the user. For the purpose of adjusting the resistance member 12 to a desired position relative to the chest of the wearer, the adjustment buckles 40 and 48 can be used to move the resistance member 12 upwardly or downwardly relative to the body of the user. Typically, the user will be wearing the usual safety harness (not shown) and the exercise belt assembly 10 is put in use over the existing harness by connecting the quick release fitting 50.

With the exercise assembly 10 in position relative to the user, the resistance member 12 offers a yielding resistance to movement within the confines of the normal seat belt equipment that may be worn to achieve exercise which normally would not be available. Such exercise is accomplished without in any way detracting from the use of the typical seat belt safety harness or equipment.

When not in use, the exercise belt assembly 10 can be released by latching the quick release 50.

Exercise equipment for use by operators and passengers in motor vehicles has been provided which can be use in conjunction with the usual safety belt harness and equipment without impairing the use of such equipment thereby making it possible for the user to accomplish some exercise by overcoming the resistance of the resilient resistance belt member 12 within the limited movement afforded by the usual safety harness.

I claim:

1. A vehicle in combination with exercise equipment for use by a person seated in the vehicle and secured by a safety belt harness, the combination comprising:

a first and a second bracket positioned in the interior of the vehicle and secured to a vehicle frame;

an elongated elastic resistance member, a pair of links, each of said links being connected to opposite ends of said resistance member, a first and a second belt, said first belt having one end connected to one of said links and the other end secured to said first bracket and said second belt having one end connected to the other of said links and the other end secured to said second bracket; and said resistance member and said pair of belts forming an elongated belt assembly adapted to extend between the brackets of the vehicle and across the shoulder and chest of the person seated in the vehicle with said resistance member being resiliently stretched during exercise movement of the person while seated in the vehicle.

2. The combination of claim 1 wherein at least one of said belts is provided with a quick release buckle allowing separation of said belt.

3. The combination of claim 1 wherein at least one of said belts is adjustable in length.

4. The combination of claim 1 wherein each of said belts are separately adjustable in length.

5. The combination of claim 1 wherein said resistance member further comprises at least one bungee cord having opposite ends anchored to said pair of links.

6. The combination of claim 1 wherein said resistance member comprises a pair of bungee cords disposed at opposite edges of said resistance member.

7. The combination of claim 6 wherein said pair of bungee cords are joined by a fabric member.

8. The combination of claim 1 wherein said links are rectilinear rings having opposed belt receiving edges, one of said edges being connected to said resistance member and the other of said edges being connected to one of said belts.

9. The combination of claim 1 further comprising a buckle associated with at least one of said belts to permit adjustment of the length of said belt.

10. A vehicle in combination with exercise equipment for use by a person seated in a vehicle, the combination comprising:

a pair of spaced apart brackets positioned in the interior of the vehicle and secured to said vehicle;

an elongated elastic resistance member having opposed ends, a pair of elongated straps each having opposed ends, means connecting one end of each of said straps to said opposed ends of said resistance member, the other ends of each of said straps being connected to said brackets of said vehicle, said resistance member and pair of straps forming an elongated belt assembly extending between said brackets and disposed generally parallel to said safety shoulder harness to resiliently stretch and resist the exercise movement of a person seated in the vehicle and wearing said harness.

11. The combination of claim 10 wherein at least one of said straps is provided with a quick disconnect fitting.

12. The combination of claim 10 further comprising an adjustment buckle positioned on one of said straps for varying the length of the belt.

13. The combination of claim 10 wherein said resistance member comprises at least one bungee cord extending longitudinally along said resistance member.

14. The combination of claim 13 wherein said at least one bungee cord is disposed adjacent an edge of said resistance member.

15. Exercise equipment for use in combination with a vehicle consisting of:

an elastic belt for providing a yielding resistance to an individual seated in said vehicle and secured by a safety belt;

a first and a second strap, said first strap having a first end secured to said belt and a second end secured to said vehicle and said second strap having a first end secured to said belt and a second end secured to said vehicle;

at least one buckle secured to at least one of said first and second straps to permit adjustment of the length of at least one of said straps, and;

said belt and said straps forming an exercise assembly adapted to extend across the individual while said individual is seated in said vehicle and resiliently stretch and resist the exercise movement of the individual.

16. The exercise equipment of claim 15, wherein said elastic belt further consists of an elastic fabric.

17. The exercise equipment of claim 15, wherein said elastic belt further consists of at least one bungee cord.

18. The exercise equipment of claim 15 wherein at least one of said straps further consists of a quick disconnect fitting.

* * * * *

UNITED STATES PATENT AND TRADEMARK OFFICE

CERTIFICATE OF CORRECTION

PATENT NO. : 6,500,103 B2
DATED : December 31, 2002
INVENTOR(S) : Edward L. Porter It is certified that error appears in the above-identified patent and that said Letters Patent is hereby corrected as shown below:

Title page,
Item [22], should read -- October 8, 1999 --;
Item [57], ABSTRACT, please delete "is" and insert -- in --;

Column 1,
Line 53, please delete "offer's" and insert -- offers --;

Column 2,
Line 51, please delete "and" and insert -- an --;
Line 52, please delete "drivers" and insert -- drivers's --;

Column 3,
Line 55, please delete "use" and insert -- used --;

Column 4,
Line 59, please delete "the belt" and insert -- said straps --.

Signed and Sealed this

Twenty-first Day of October, 2003

JAMES E. ROGAN
*Director of the United States Patent and Trademark Office*